US006315395B1

(12) United States Patent
Imai

(10) Patent No.: US 6,315,395 B1
(45) Date of Patent: Nov. 13, 2001

(54) INK JET APPARATUS AND CONDUCTIVE INK MIXTURE

(75) Inventor: Ryoichi Imai, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 1066 days.

(21) Appl. No.: 08/505,020

(22) Filed: Jul. 21, 1995

(30) Foreign Application Priority Data

Jul. 29, 1994 (JP) ..... 6-178854

(51) Int. Cl.[7] ..... B41J 2/05
(52) U.S. Cl. ..... 347/56
(58) Field of Search ..... 347/61, 100, 55, 347/56; 106/20 D

(56) References Cited

U.S. PATENT DOCUMENTS

| | | | | |
|---|---|---|---|---|
| 4,243,994 | * | 1/1981 | Kobayashi | 347/100 |
| 4,595,937 | * | 6/1986 | Conta | 347/61 X |
| 4,597,794 | * | 7/1986 | Ohita | 347/100 X |
| 4,717,926 | | 1/1988 | Hotomi | 347/55 |
| 4,836,852 | * | 6/1989 | Knirsch | 347/100 X |

FOREIGN PATENT DOCUMENTS

| | | | | |
|---|---|---|---|---|
| 0 106 802 | | 4/1984 | (EP) | B41J/3/04 |
| 3-297650 | | 12/1991 | (JP) | B41J/2/015 |
| 402185446 | * | 7/1990 | (JP) | B41J/2/05 |
| 402286348 | * | 11/1990 | (JP) | B41J/2/05 |
| 3-110170 | * | 5/1991 | (JP) | B41J/2/05 |
| 405064886 | * | 3/1993 | (JP) | B41J/2/05 |
| 61-189946 | | 8/1986 | (JP) | B41J/3/04 |
| 363209944 | * | 8/1988 | (JP) | B41J/3/04 |
| 58-155966 | | 9/1993 | (JP) | B41J/3/16 |

* cited by examiner

*Primary Examiner*—John Barlow
*Assistant Examiner*—Julian D. Huffman
(74) *Attorney, Agent, or Firm*—Kanesaka & Takeuchi

(57) ABSTRACT

An ink jet apparatus is formed of a storing section for storing an electrically conductive ink, an electrode device formed in the storing section, and a nozzle. The conductive ink contains an electrically conductive liquid and an electrically conductive material having an electrical conductivity higher than that of the conductive liquid. The electrode device applies an alternating current to the conductive ink stored in the storing section to generate bubbles in the conductive liquid. The conductive ink is ejected through the nozzle due to generation of the bubbles by application of the alternating current.

6 Claims, 10 Drawing Sheets

INK JET APPARATUS AND CONDUCTIVE INK MIXTURE

BACKGROUND OF THE INVENTION

1. Field of the Invention

The present invention relates to an ink jet apparatus capable of forming a high density recording image, and to a conductive ink mixture effective to be used for the ink jet apparatus.

2. Description of the Related Art

Conventionally, there have been known ink jet apparatuses with a bubble jet system and a current-carrying jet system. The bubble jet system is operated by vaporizing ink in a vessel using heat generated by a heat-generating resistor for generating bubbles of ink, and discharging the ink increased in pressure from a nozzle of the vessel. On the other hand, the current-carrying jet system is operated by heating conductive ink by applying a current thereto, vaporizing ink by the heat thus generated for generating bubbles of ink, and discharging the ink increased in pressure from a nozzle of a vessel.

In the bubble jet system, ink contacted with the heat-generating surface of the heat-generating resistor is vaporized by heating. Specifically, in this system, since the heat is imparted to ink from the heat-generating surface of the heat-generating resistor, an energy imparted to ink is limited by the area of the heat-generating surface of the heat-generating resistor, with a result that a discharge energy to be applied to ink is limited. Even when a large amount of current is allowed to flow to the heat-generating resistor for heating ink to the extent over the above limitation, the discharge energy to be applied to ink is not increased and the heat-generating resistor tends to be broken.

On the other hand, in the current-carrying jet system, since conductive ink applied with a current has a homogeneous composition and thereby it has a constant resistance, there is no means for increasing an energy imparted to ink and enlarging the discharge force to be applied to ink.

Recently, in the ink jet apparatus, it has been required to enhance the density of a dot to be printed for improving the fineness of the printing. To meet this requirement, the opening diameter and the arrangement pitch of each nozzle for discharging ink must be smaller than conventional values. In the prior art ink jet apparatus, however, the discharge force to be applied to ink cannot be easily increased, and when the opening diameter and the arrangement pitch of each nozzle are made smaller while the discharge force to be applied to ink is kept as being conventional, ink sediment and refuse tend to be collected in the nozzle, to thus clog it. In this way, the prior art ink jet apparatus has a limitation in the discharge force to be applied to ink, and consequently, it presents a problem having a difficulty in improving the fineness of printing.

SUMMARY OF THE INVENTION

An object of the present invention is to provide an ink jet apparatus capable of coping with the tendency toward the fineness of printing, and a conductive ink mixture effective to be used for the ink jet apparatus.

To achieve the above object, according to a preferred mode in a first aspect, there is provided an ink jet apparatus comprising:

a containing or storing section containing a conductive ink mixture or conductive ink having conductive particles and conductive liquid;

an electrode means or component for carrying an alternating current to the conductive ink mixture in the containing section thereby bubbling the conductive ink mixture; and a nozzle component for discharging the conductive ink mixture bubbled by carrying the alternating current.

According to a preferred mode in a second aspect, there is provided an ink jet apparatus according to the preferred mode described in the first aspect, wherein a conductivity of each of the conductive particles is higher than that of the liquid.

According to a preferred mode in a third aspect, there is provided an ink jet apparatus according to the preferred mode described in the second aspect, wherein the conductive particle has a conducting property at least on the surface thereof, and a conductivity of the conductive particle has a magnitude enough to generate the heat capable of bubbling the conductive ink mixture due to the skin effect generated by an alternating current.

According to a preferred mode in a fourth aspect, there is provided an ink jet apparatus according to the preferred mode described in the third aspect, wherein the conductive particle is smaller in size than the opening diameter of the nozzle component.

According to a preferred mode in a fifth aspect, there is provided an ink jet apparatus according to the preferred mode described in the fourth aspect, wherein the containing section comprises a row of containing portions partitioned by a pair of substrates facing to each other at a specified interval and a plurality of partitioning members spaced at specified intervals between a pair of the substrates;

the nozzle component comprises a row of nozzles each being opened at one end portion of each containing portion;

the electrode component comprises a plurality of pairs of electrodes including a plurality of first electrodes provided on the inner surface of one of the substrates for each containing portion and a second electrode commonly provided on the inner surface of the other of the substrates; and the ink jet apparatus further includes an AC power supply for supplying an alternating current across each pair of the first electrode and the second electrode, a plurality of switching means respectively provided on the first electrodes, and a means for supplying the conductive ink mixture to each containing portion.

According to a preferred mode in a sixth aspect, there is provided an ink jet apparatus according to the preferred mode described in the fourth aspect, wherein the containing section comprises a row of containing portions partitioned by a pair of substrates facing to each other at a specified interval and a plurality of partitioning members spaced at specified intervals between a pair of the substrates;

the nozzle component comprises a row of nozzles each being opened at one end portion of each containing portion;

the electrode component comprises a plurality of pairs of electrodes independently provided for each containing portion; and the ink jet apparatus further includes an AC power supply for supplying an alternating current across each pair of the electrodes provided for each containing portion, a switching means provided for each pair of the electrodes in each of the containing portions, and a means for supplying the conductive ink mixture to each containing portion.

According to a preferred mode in a seventh aspect, there is provided an ink jet apparatus according to the preferred mode described in fourth aspect, wherein the electrode component comprises longitudinal electrodes spaced at specified intervals in parallel to each other;

the containing section comprises a row of containing portions partitioned by the electrodes and a pair of facing insulating members disposed in such a manner as to put the electrodes therebetween;

the nozzle component comprises a plurality of a row of nozzles each being opened at one end portion of each containing portion; and the ink jet apparatus further includes an AC power supply for supplying an alternating current across the adjacent two electrodes, a plurality of switching means provided for selecting the adjacent two electrodes to be applied with an alternating current from a plurality of the electrodes, and a means for supplying the conductive ink mixture to each containing portion.

According to a preferred mode in an eighth aspect, there is provided a conductive ink mixture comprising conductive liquid, and conductive particles dispersed in the liquid, each of the conductive particles having a conductivity higher than that of the liquid.

According to a preferred mode in a ninth aspect, there is provided a conductive ink mixture according to the preferred mode described in the eighth aspect, wherein the conductive particle has a conducting property at least on the surface thereof, and a conductivity of the conductive particle has a magnitude enough to generate heat capable of bubbling the liquid due to the skin effect generated by an alternating current.

With the construction of each invention described above, an AC current is applied across each pair of electrodes for carrying a current to a conductive ink mixture in each containing portion. The AC current flows to conductive particles each having a conductivity higher than that of liquid, and particularly, it concentratedly flows on the surface of each conductive particle by the skin effect. The conductive ink mixture in the containing portion held between each pair of electrodes contains a large number of the conductive particles, and since the total surface area of these conductive particles is large, an energy larger than that in the conventional manner can be imparted to the conductive ink mixture. The liquid is heated by the heat generated on the surfaces of the conductive particles and generates bubbles, and the conductive ink mixture thus increased in pressure is discharged from each nozzle.

DESCRIPTION OF THE PREFERRED EMBODIMENTS

Figure 1:
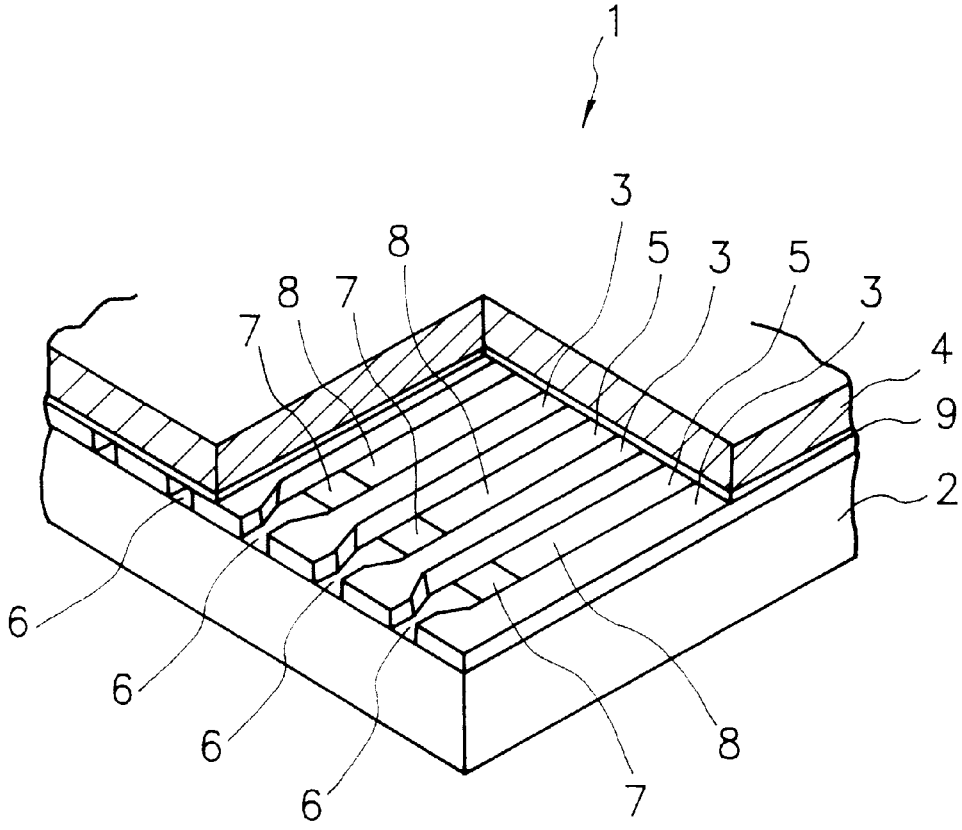
FIG. 1 is a perspective view of a first embodiment, with parts partially cutaway.

An ink jet apparatus 1 in a first embodiment will be described with respect to FIGS. 1 to 7. A plurality of slender bar-like partitioning members 3 is spaced at specified intervals on the upper surface of a first insulating substrate 2. The leading end of each partitioning member 3 is widened, and the front end surface thereof is aligned with the front end surface of the first substrate 2. A second substrate 4 is provided on these partitioning members 3. A plurality of approximately rectangular containing portions 5 for containing conductive ink mixture 20 is provided among the partitioning members 3, 3 spaced at the specified intervals, the first substrate 2, and the second substrate 4. A rectangular nozzle 6 for discharging the conductive ink mixture 20 in each containing portion 5 is opened on the front end surface of the containing portion 5.

Electrodes 7 are formed on the first substrate 2 for each containing portion 5. The electrode 7 is a part of a band-like electrode provided in each containing portion 5. The leading end portion of each band-like electrode remains as the electrode 7, and the other portion thereof is covered with an insulating film 8.

An electrode 9 is formed over the lower surface of the second substrate 4. The electrode 9, which is paired with each electrode 7, is formed in such a manner as to be common to each electrode 7. Each of the electrodes 7, 9 is made of a conductive material in the form of a thin film or a thick film by a simple process such as printing or plating.

Figure 2:
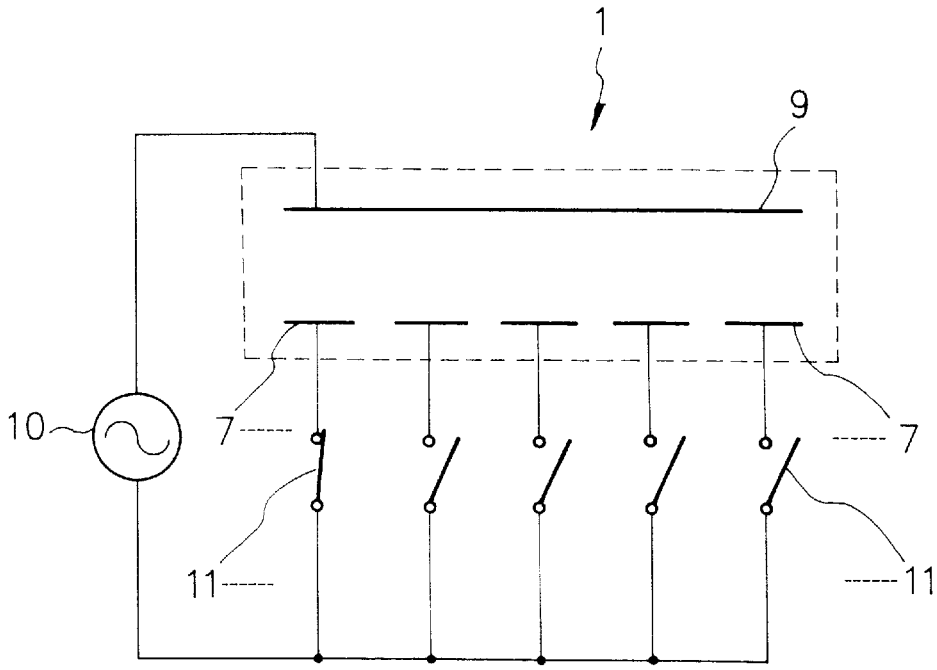
FIG. 2 is a circuit diagram showing a drive circuit of the first embodiment.

As shown in FIG. 2, an AC power source 10 is connected between each pair of the electrodes 7, 9. Each electrode 7 includes a switching means 11 for supplying a voltage across each pair of the electrodes 7, 9 in a specified containing portion 5 thereby carrying a current to the conductive ink mixture 20 present between the electrodes 7, 9.

The ink jet apparatus 1 has a means for supplying the conductive ink mixture 20. The supplying means may be of a structure having an ink supply pipe introduced from the ink supply means to the opening end portion of each containing portion 5 on the opposed side to the nozzle 6. Each containing portion 5 is usually filled with the conductive ink mixture 20 by means of such an ink supplying means.

The conductive ink mixture 20 mainly contains liquid 21 having a resistivity of $1\times10^{7}$ Ωcm or less conductivity of $1\times10^{-7}$/Ωcm or more. The ink mixture 20 contains conductive particles 22 each having a conductivity higher than that of the liquid 21. The conductive particles 22 are preferably composed of particles each having a conducting property at least on the surface, for example, carbon particles, metal particles, micro-particles covered with carbon, microcapsules each having a conducting property on the surface. The conductive particles 22 may have a particle size in the range of from 0.01 to 10 μm for obtaining an excellent result in generating heat due to the skin effect, and preferably, each of the conductive particles 22 has a size small enough not to clog the nozzle 6.

In this embodiment, an alternating current passing through the conductive particles 22 in the conductive ink mixture 20 is restricted onto the surfaces of the upper layers of the conductive particles 20 and thereby it does not enter the insides of the conductive particles 20, that is, it flows only along the surfaces of the conductive particles 22. Such a phenomenon is called the skin effect. In this embodiment, the current concentratedly flows on the surfaces of the conductive particles 22 by the skin effect, thereby increasing an effective resistance of each of the conductive particles 22. The surfaces of the conductive particles 22 are thus heat-generated, thereby causing the ink to generate bubbles. For this reason, the surface and the vicinity thereof of each conductive particle 22 preferably has a resistance capable of generating the heat sufficient to generate bubbles of ink by the current-carrying accompanied by the above-described skin effect.

Each of the conductive particles 22 preferably has a conductivity higher than that of the liquid 21 mainly constituting the conductive ink mixture 20, and at least the surface thereof preferably has a specified resistance.

Figure 3:
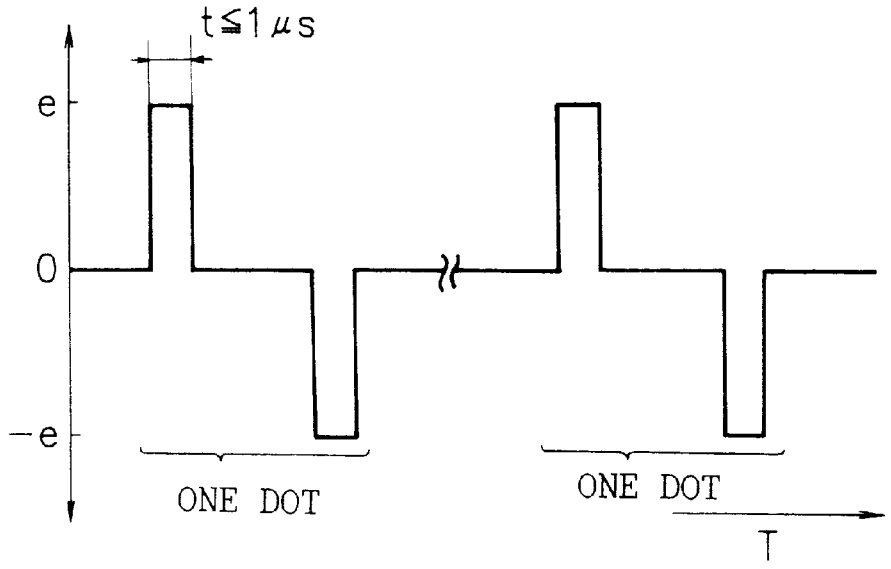
FIG. 3 is a view showing the waveform of an example of alternating current in the first embodiment.
Figure 4:
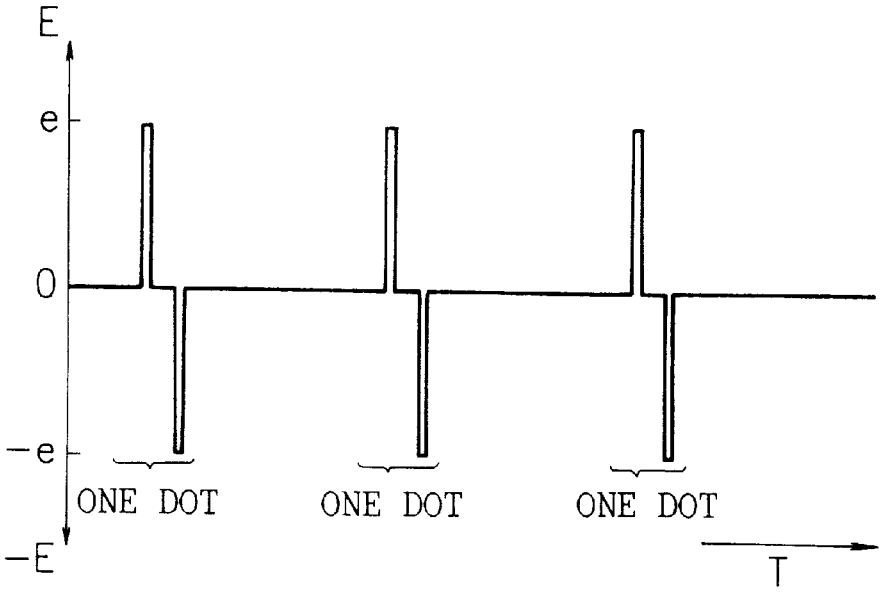
FIG. 4 is a view showing the waveform of another example of alternating current in the first embodiment.

In this embodiment, the alternating current applied by the AC power source 10 across the electrodes 7, 9 will be described below. The alternating current described in this embodiment and claims extensively means one exhibiting the skin effect, while excluding a direct current. Accordingly, the waveform of the current includes not only a sinusoidal wave but also a sinusoidal wave appearing only on one of positive and negative sides. Moreover, it includes not only a pulse wave appearing on both the positive and negative sides as shown in FIG. 3 or 4 but also a pulse wave appearing only one of both the positive and negative sides. In addition, the shape of the pulse wave is not necessarily the regularly rectangular shape shown in FIG. 3, and the shape of the sinusoidal wave may include a strain.

The alternating current in this embodiment is preferably high in the frequency of the sinusoidal wave or pulse wave for significantly enhance the skin effect. This is effective to allow the current to concentratedly flow on the surface of each conductive particles 2, and to increase an effective resistance of the conductive particle 22. As a result, the conductive particles 22 are easy to generate the heat. The heat-generation amount of the conductive ink mixture 20 can be freely controlled by suitably setting the frequency of an alternating current applied across the electrodes 7, 9, the current value, density of the conductive particles 22 in the conductive ink mixture 20, and the conductivity and resistance of the conductive particles 22.

In the prior art ink jet apparatus of heating ink directly contacted with a heat-generating resistor for generating bubbles of ink, the heat-generating area is constituted of only the area of the heat-generating resistor. Differently from such a prior art ink jet apparatus, the heat-generating area of the inventive ink jet apparatus 1 is constituted of the surfaces of a large number of the conductive particles 22 contained in the conductive ink mixture 20 in a space held between each pair of the electrodes 7, 9, and since the total surface area of the conductive particles 22 is large, an energy larger than that of the prior art ink jet apparatus can be imparted to the conductive ink mixture 20. Accordingly, it becomes easy to increase a discharge force to be applied to ink, and to improve the printing quality by making smaller the inside diameter and the arrangement pitch of each nozzle 6.

Figure 5:
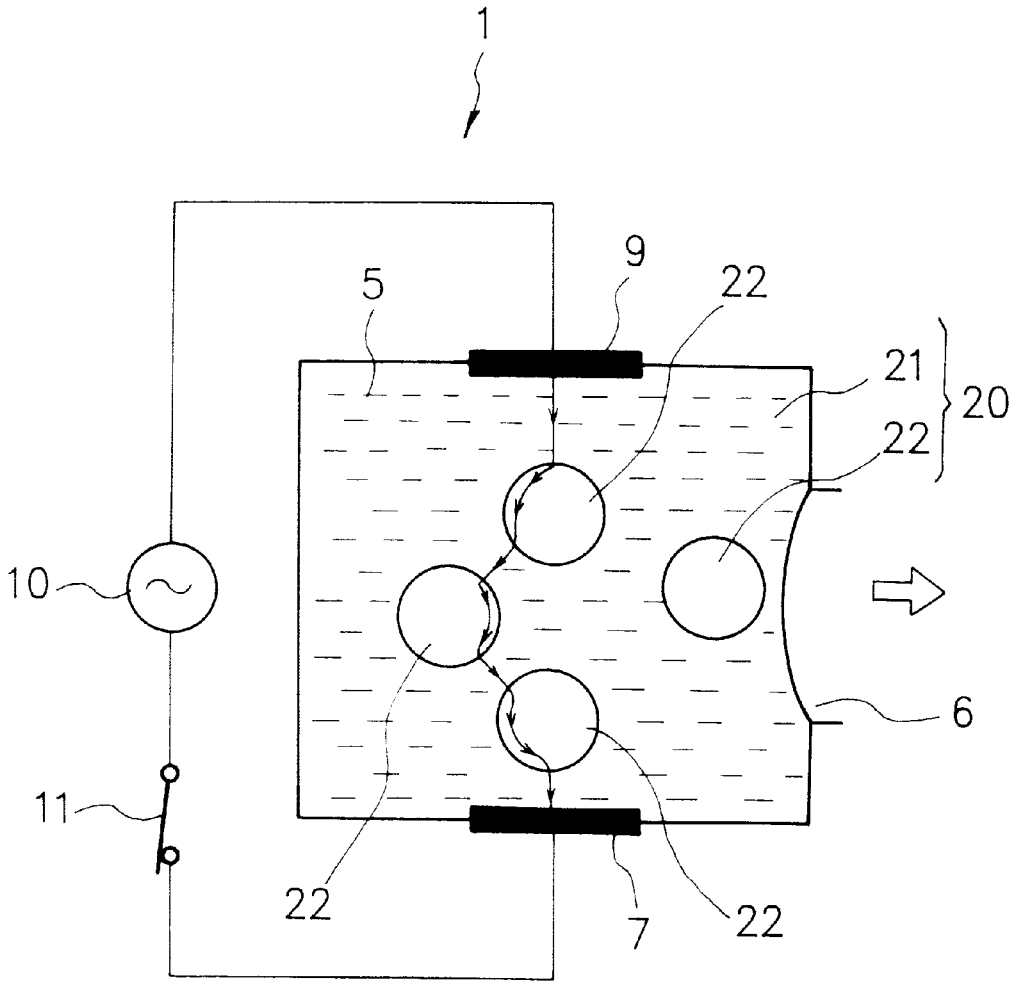
FIG. 5 is a schematic view showing the state of carrying an alternating current in the first embodiment.

The function of the present invention will be described below. An alternating current, for example having a pulse wave shown in FIG. 3 or 4 is applied across the electrode 7, 9. As shown in FIG. 5, the current does not uniformly flow in the conductive ink mixture 20 and is collected to the conductive particles 22 each having a conductivity higher than that of the ink 21. At this time, the current is concentrated on the surface of each conductive particle 22 due to the skin effect. Since the surface of each conductive particle 22 has a suitable electric resistance, the current concentrated on the surface due to the skin effect generates heat. The conductive ink mixture 20 in a space held between each pair of the electrodes 7, 9 contains a large number of the conductive particles 22, and the total surface area of the conductive particles 22 contacted with the ink 21 is very large. Consequently, it becomes possible to carry the current in a larger amount than the conventional manner, and hence to concentratedly impart a thermal energy to the ink 21.

Figures 6A, 6B, 6C, 6D, 6E:
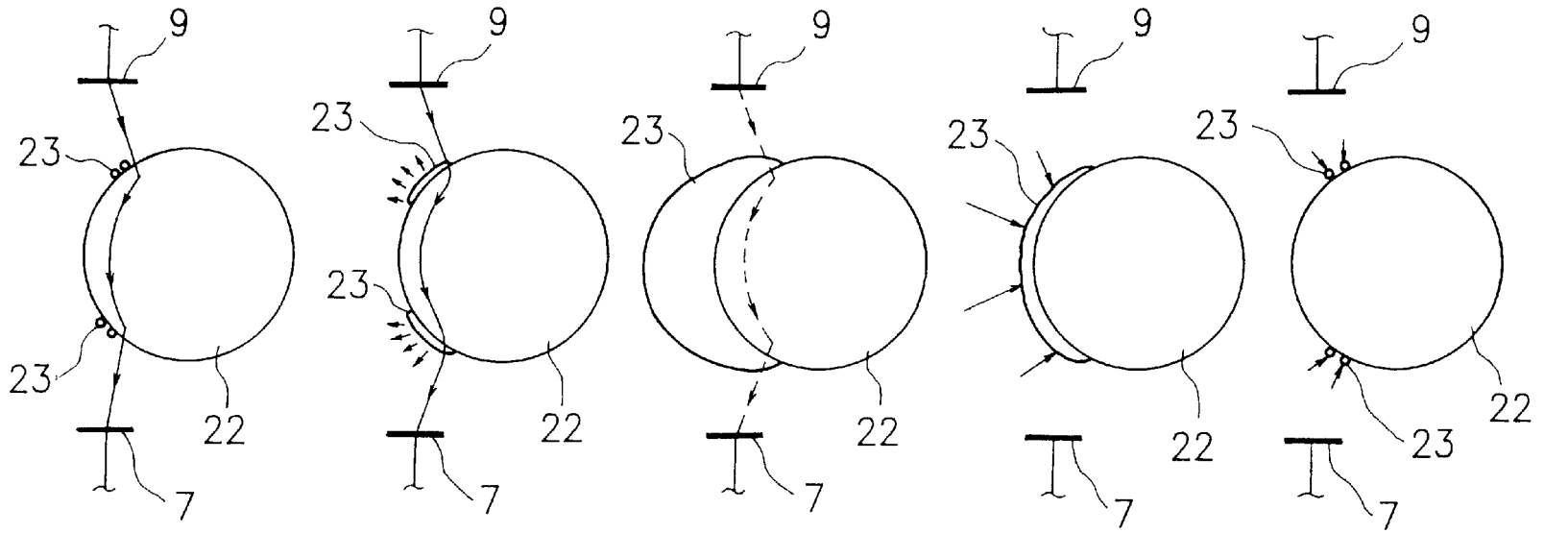
FIGS. 6(*a*) to 6(*e*) are views showing the states that bubbles are generated in conductive ink mixture in the first embodiment.
Figure 7A:
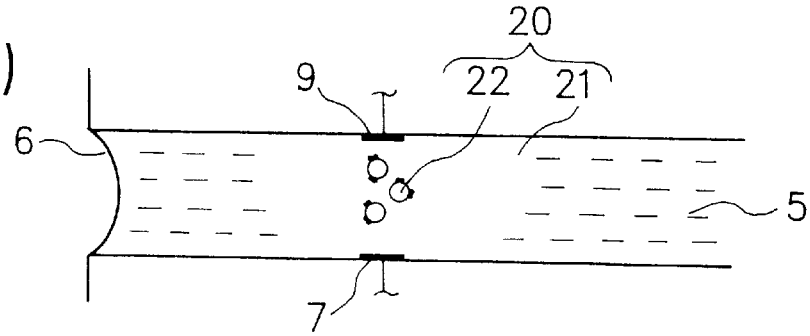
FIGS. 7(*a*) to 7(*e*) are views showing the states that bubbles are generated in conductive ink mixture and the ink is discharged in the first embodiment.
Figure 7B:
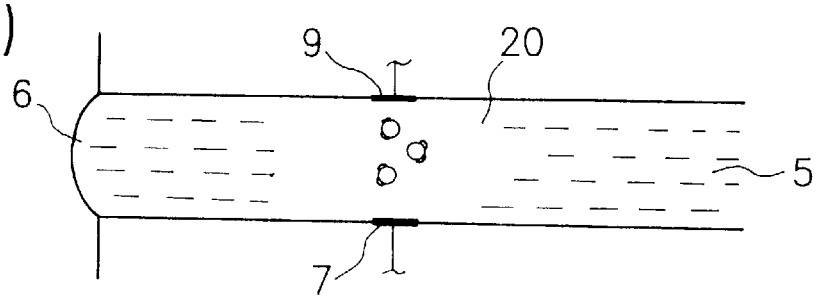
Figure 7C:
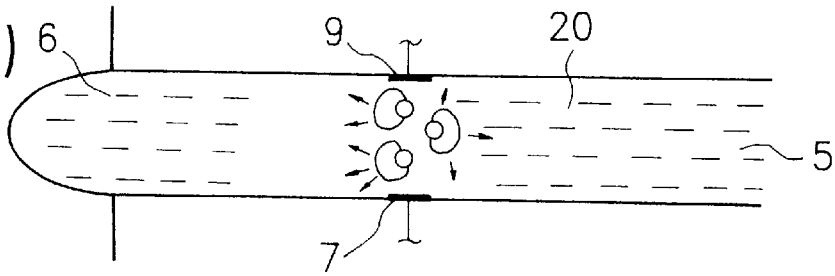
Figure 7D:
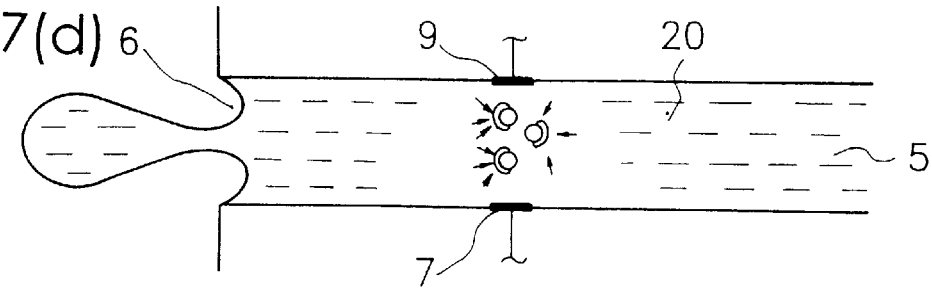
Figure 7E:
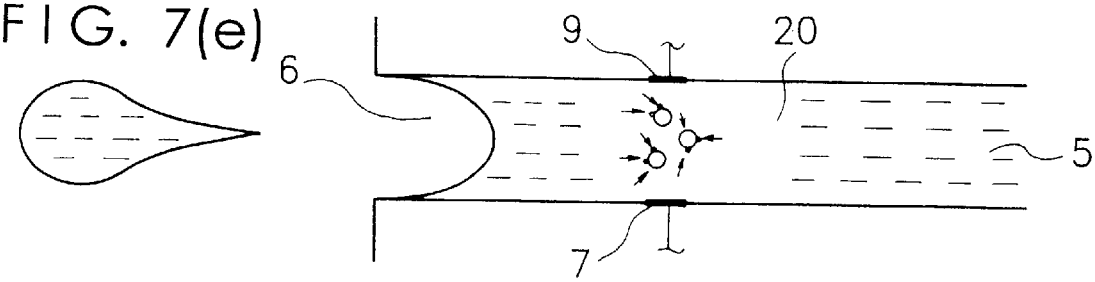

As shown in FIG. 6(*a*), when a current flows on the surface of each conductive particle 22, heat is particularly concentrated at two points on the surface of the conductive particle 22 through which the current flows, and two small bubbles 23 are generated in the ink near these points. As shown in FIG. 6(*b*), the bubbles 23 thus generated become larger, and as shown in FIG. 6(*c*), they are integrated with each other, to form one bubble. As shown in FIGS. 6(*d*) and 6(*e*), when the heat-generation is suppressed by stopping the current-carrying, the bubble 23 rapidly becomes smaller.

When a bubble is generated in the processes shown in FIGS. 6(*a*) to 6(*c*) in the conductive ink mixture 20 between each pair of the electrodes 7, 9, the conductive ink mixture 20 in the containing portion 5 is, as shown in FIGS. 7(*a*) to 7(*e*), applied with a pressure and thus discharged from the nozzle 6 disposed on the front side. The states shown in FIGS. 7(*a*) to 7(*e*) correspond to those shown in FIGS. 6(*a*) to 6(*e*), respectively.

In the ink jet apparatus 1 shown in FIG. 1, ink is discharged from a desired nozzle 6 at a suitable timing by suitably switching each switching means 11 in the electric circuit shown in FIG. 2. A printing paper sheet carried in the specified direction in front of each nozzle 6 is stuck with an ink discharged from the nozzle 6 in the dot shape, to be thus printed with a desired image.

Figure 8:
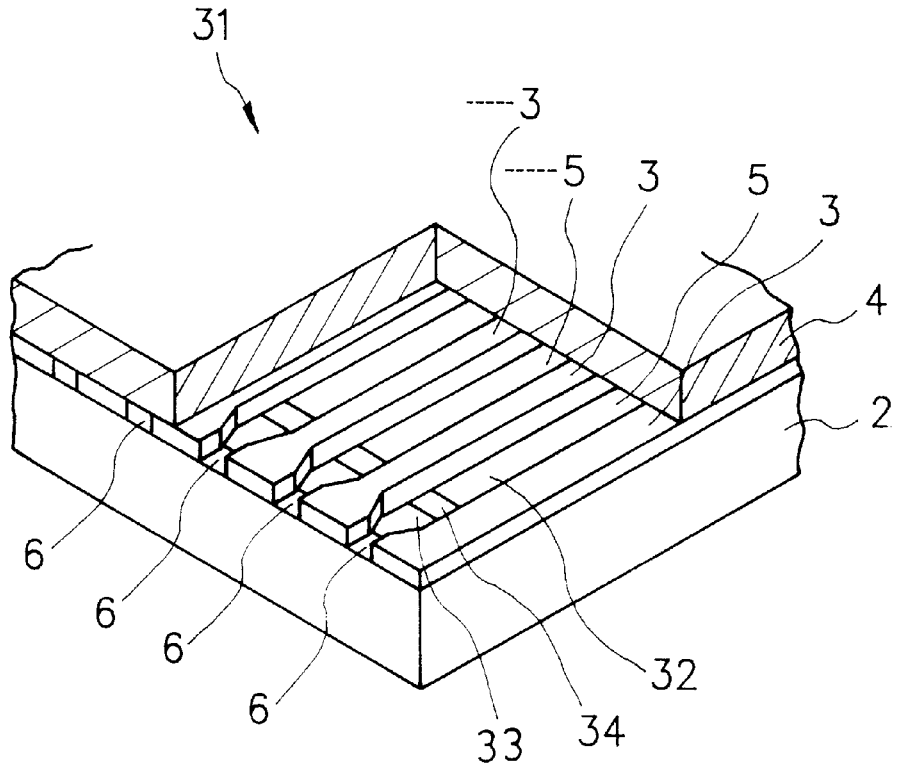
FIG. 8 is a perspective view of a second embodiment, with parts partially cutaway.
Figure 10:
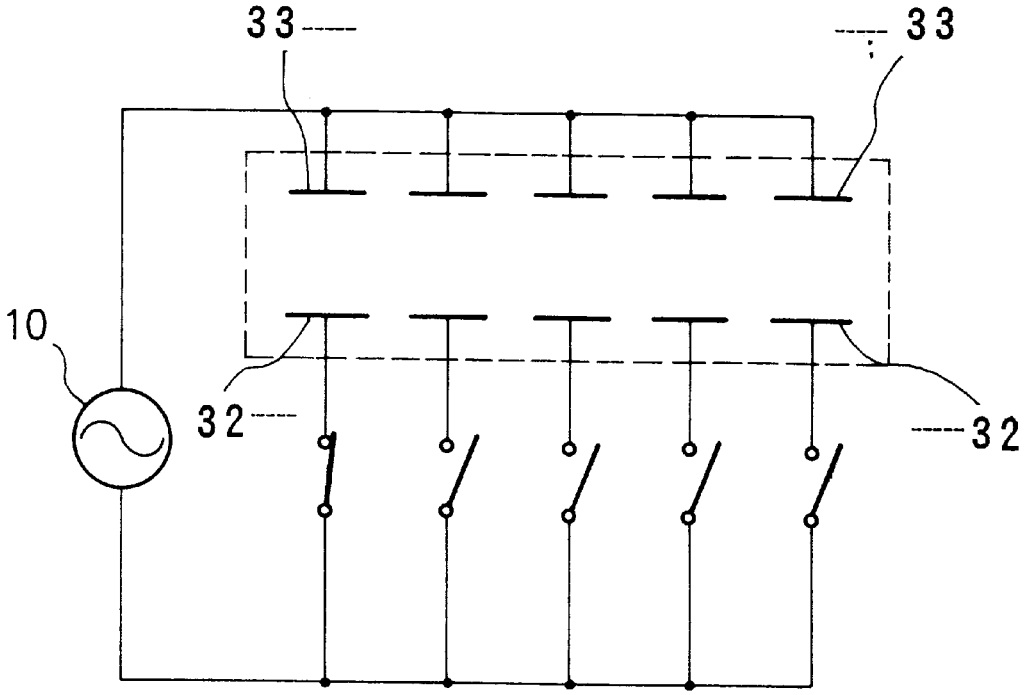
FIG. 10 is a circuit diagram of a drive circuit of the second embodiment.

FIG. 8 is a perspective view of the ink jet apparatus 31 in a second embodiment, with parts partially cutaway. In this embodiment, parts corresponding to those in the first embodiment are indicated at the same characters, and the explanation thereof is omitted. Facing electrodes 33, 32 are disposed on a first substrate 2 in each containing portion 5 at a specified interval. The electrode 33 is formed in a band-like shape, and is covered with an insulating film 34 while a portion thereof being exposed therefrom. The electrode 32 is formed in a band-like shape on the insulating film 34. Both the electrodes 32, 33 are connected to a drive circuit at the end portion of the first substrate 2 on the opposed side to a nozzle 6. No electrode is provided on the inner surface of a second substrate 4. FIG. 10 shows the drive circuit in this embodiment shown in FIG. 8 for individually driving each pair of the electrodes 32, 33 in each containing portion 5. In this embodiment, the same effect as that in the first embodiment can be obtained.

Figure 9:
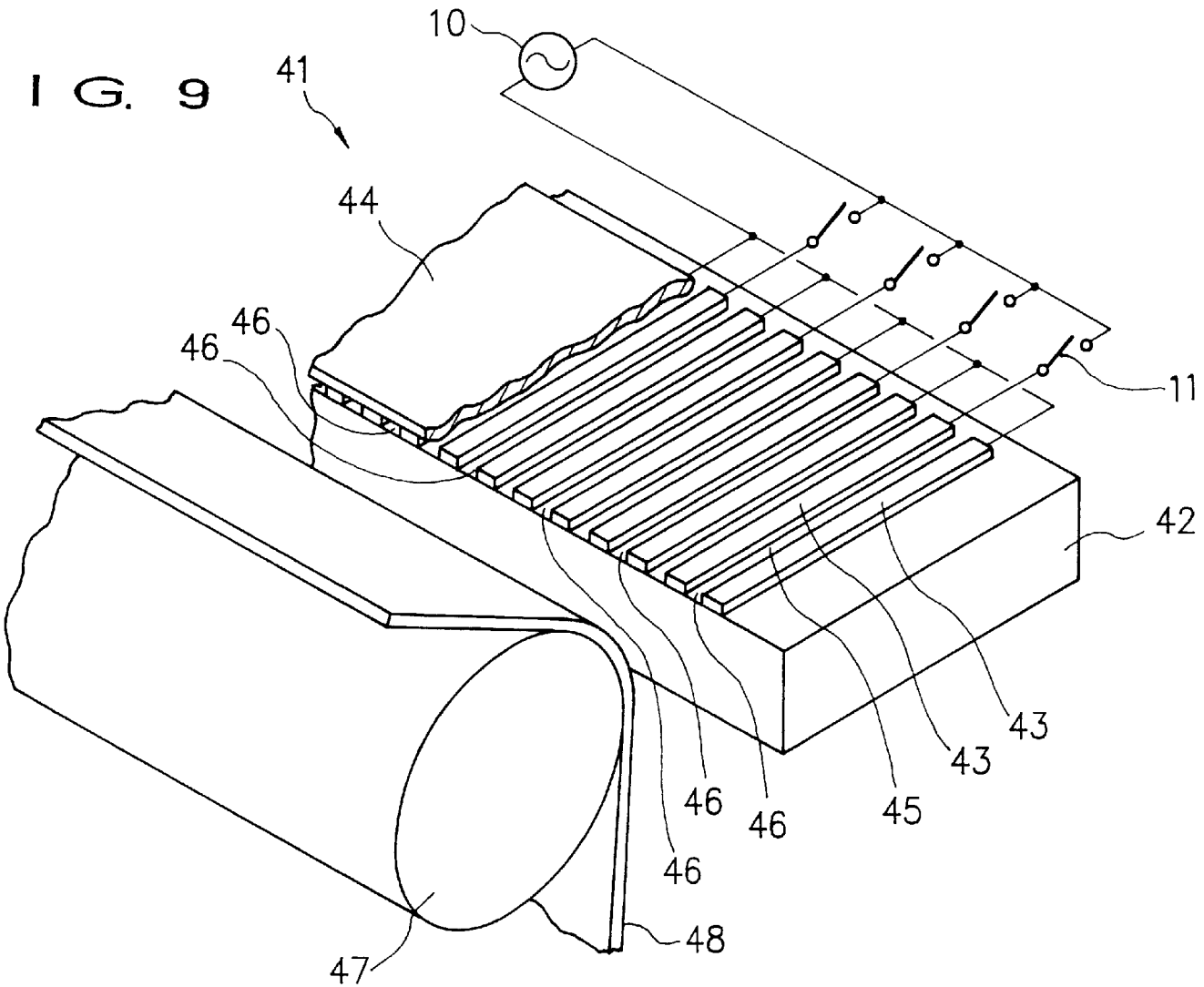
FIG. 9 is a perspective view of a third embodiment, with parts partially cutaway.

FIG. 9 is a perspective view of an ink jet apparatus 41 in a third embodiment, with parts partially cutaway. Band-like electrodes 43 are spaced at specified intervals on a substrate 42 formed of an insulating member. A pair of adjacent electrodes 43, 43 constitute one set of the electrodes 43, 43, and are connected to an AC power supply 10. A switching means 11 is provided for each pair of the electrodes 43, 43 for selectively applying an alternating current to each pair of the electrodes 43, 43 at a specified timing.

The electrodes 43 on the substrate 42 are covered with a film 44 made of an insulating material. Each containing portion 45 for containing the conductive ink mixture 20 is formed of a pair of the electrodes 43, 43 adjacent to each other, substrate 42, and film 44. The front end surface of the containing portion 45 is opened, to form a nozzle 46 for discharging the conductive ink mixture 20. The means for supplying the conductive ink mixture 20 to the containing portion 45 may be the same as that in the first embodiment.

A platen roller 47 is provided in front of the nozzles 46. A printing paper sheet 48 is carried along with the rotation of the platen roller 47, and the ink jet apparatus 41 is driven in synchronization with the movement of the printing paper sheet. The switching means 11 is suitably switched, so that ink is discharged from a desired nozzle 46 at a desired timing. The ink thus discharged is stuck on the printing paper sheet 48 in a dot-shape, thus printing a desired image.

The functions in the second and third embodiments, such as the current-carrying across the electrodes, heat-generation due to the skin effect, generation of bubbles, and discharge of ink are the same as those in the first embodiment. In the second and third embodiments, a pair of the electrodes 33, 32, and a pair of the electrodes 43, 43 corresponding to the nozzle 6 and 46 are electrically divided, respectively, so that a current flowing between a pair of the electrodes for driving tends to exert a small effect on a pair of the electrodes adjacent thereto. In the case where one electrode 9 of a pair of the electrodes constitutes the common electrode between a pair of the electrodes just as the first embodiment, it becomes possible to easily manufacture the electrodes. Moreover, in the third embodiment shown in FIG. 9, the interval between the adjacent electrodes 43, 43 corresponds to the opening width of the nozzle 46; however, the opening of the nozzle 46 may be made smaller by narrowing the interval between the leading ends of the adjacent electrodes 43, 43 or making small the height of the electrode 43.

According to the ink jet apparatus and the conductive ink mixture of the present invention, an alternating current is imparted to the conductive ink mixture containing conductive particles and is concentrated on the surface of each conductive particle due to the skin effect, to thus generate heat. As a result, the energy density is enhanced and the ink can be discharged at a high pressure. Thus, it becomes possible to make small the inside diameter and the arrangement pitch of each nozzle, and hence to perform the printing with a high fineness.

What is claimed is:

1. An ink jet apparatus, comprising:

a storing section for storing an electrically conductive ink containing an electrically conductive liquid and an electrically conductive material having an electrical conductivity higher than that of the conductive liquid, said conductive material comprising a plurality of conductive particles having at least conductive surfaces with electrical conductivity to generate heat thereat;

electrode means located in the storing section for applying an alternating current to said conductive ink stored in the storing section, said conductive particles in said conductive ink allowing the alternating current to flow therethrough and generating heat thereat for forming bubbles in the conductive liquid by a skin effect caused by application of said alternating current; and a nozzle attached to the storing section for ejecting the conductive ink due to generation of said bubbles by application of the alternating current.

2. An ink jet apparatus according to claim 1, wherein each of said conductive particles has a size smaller than an opening size of said nozzle.

3. An ink jet apparatus according to claim 2, wherein said storing section comprises a plurality of storing chambers defined and separated from each other by a pair of substrates opposed to each other and spaced by a predetermined distance, and a plurality of partition members located between said pair of substrates and arranged at predetermined intervals;

said nozzle comprises a plurality of nozzle portions arranged at predetermined intervals so as to respectively correspond to said storing chambers, each nozzle portion opening at one end of each corresponding storing chamber;

said electrode means comprises a plurality of pairs of electrodes each pair having first electrode provided on an inner surface of one of said substrates in one storing chamber and a second electrode provided on an inner surface of the other of the substrates in said one storing chamber; and said ink jet apparatus further comprises a power source for applying the alternating current between said first and second electrodes, a plurality of switching means respectively connected to said first electrodes, and ink supply means for supplying said conductive ink to said storing chambers.

4. An ink jet apparatus according to claim 2, wherein said storing section comprises a plurality of storing chambers defined and separated from each other by a pair of substrates opposed to each other and spaced by a predetermined distance, and a plurality of partition members located between said pair of substrates and arranged at predetermined intervals;

said nozzle comprises a plurality of nozzle portions arranged at predetermined intervals so as to respectively correspond to said storing chambers, each nozzle portion opening at one end of each corresponding storing chamber;

said electrode means comprises a plurality of pairs of electrodes, each pair being provided in said storing chambers; and said ink jet apparatus further comprises a power source for applying the alternating current between each pair of the electrodes in each storing chamber, a plurality of switching means respectively connected to said plurality of pairs of the electrodes, and ink supply means for supplying said conductive ink to said storing chambers.

5. An ink jet apparatus according to claim 2, wherein said electrode means comprises a plurality of elongated electrodes arranged in parallel at predetermined intervals;

said storing section comprises a plurality of storing chambers defined and separated from each other by said electrodes and a pair of insulating members opposed to each other with said electrodes interposed therebetween;

said nozzle comprises a plurality of nozzle portions arranged at predetermined intervals so as to respectively correspond to said storing chambers, each nozzle portion opening at one end of each corresponding storing chamber; and said ink jet apparatus further comprises a power source for applying the alternating current between the electrodes in the respective storing chambers, a plurality of switching means, each being connected to one of the electrodes in the storing chamber, and ink supply means for supplying said conductive ink to said storing chambers.

6. A conductive ink comprising an electrically conductive liquid and an electrically conductive material dispersed in said conductive liquid, said conductive material having an electrical conductivity higher than that of said conductive liquid and comprising a plurality of conductive particles to allow an alternating current to flow through the conductive particles, said conductive particles having at least conductive surfaces having electrical conductivity to generate heat thereat for forming bubbles on the conductive particles in said conductive liquid by a skin effect caused by application of the alternating current.

* * * * *